United States Patent [19]

Kawashima et al.

[11] Patent Number: 4,590,693

[45] Date of Patent: May 27, 1986

[54] BASEBALL OR SOFTBALL SHOE SOLE

[75] Inventors: Yukio Kawashima, Akashi; Kounosuke Nishijima, Osaka, both of Japan

[73] Assignee: Mizuno Corporation, Osaka, Japan

[21] Appl. No.: 622,165

[22] Filed: Jun. 19, 1984

[30] Foreign Application Priority Data

Jun. 21, 1983 [JP] Japan ..... 58-95378[U]

[51] Int. Cl.[4] ..... A43B 5/00; A43C 15/16

[52] U.S. Cl. ..... 36/126; 36/134; 36/67 D

[58] Field of Search ..... 36/126, 136, 134, 127, 36/128, 67 D, 67 A, 65

[56] References Cited

U.S. PATENT DOCUMENTS

| | | | |
|---|---|---|---|
| 993,682 | 5/1911 | Heusser | 36/134 |
| 1,355,827 | 10/1920 | Finneran | 36/134 |
| 1,515,330 | 11/1924 | Bell | 36/67 D |
| 1,923,365 | 8/1933 | Gaines | 36/670 |
| 2,083,177 | 6/1937 | Wimmenauer | 36/134 |
| 2,268,992 | 1/1942 | Nofziger | 36/134 |
| 2,479,793 | 8/1949 | Tarlow | 36/134 |
| 3,043,026 | 7/1962 | Semon | 36/134 |
| 3,403,461 | 10/1968 | McCarney | 36/134 |
| 4,315,374 | 2/1982 | Sneeringer | 36/126 |
| 4,380,878 | 4/1983 | Skaja | 36/134 |

FOREIGN PATENT DOCUMENTS

| | | | |
|---|---|---|---|
| 2535624 | 7/1976 | Fed. Rep. of Germany | 36/67 D |
| 2501561 | 7/1976 | Fed. Rep. of Germany | 36/134 |
| 2826968 | 1/1980 | Fed. Rep. of Germany | 36/126 |
| 3235475 | 3/1984 | Fed. Rep. of Germany | 36/126 |
| 203123 | 2/1939 | Switzerland | 36/67 D |

*Primary Examiner*—Werner H. Schroeder
*Assistant Examiner*—Steven N. Meyers
*Attorney, Agent, or Firm*—Fleit, Jacobson, Cohn & Price

[57] ABSTRACT

A baseball or softball shoe with its sole having a plurality of individual spikes which limitedly penetrate into the ground to the optimum depth to enhance the player's ability to run fast. A plurality of projections are formed with the sole adjacent to its periphery in forefoot and heel regions of the sole. The forefoot region is also provided with a plurality of second projections integral with the sole in the inside of the spikes.

1 Claim, 3 Drawing Figures

BASEBALL OR SOFTBALL SHOE SOLE

BACKGROUND OF THE INVENTION

This invention relates to baseball or softball shoes with spikes and has for its purpose the provision of a shoe sole which limits penetration of the spikes into the ground to the optimum depth to enhance the player's ability to run fast, provides sufficient stabilization of the sole to prevent the player from slipping and incurring sprains and minimizes the likelihood of injuring another player with the spikes on the forefoot of the shoe sole.

Conventional baseball or softball shoes have either interconnected spikes or individual L-shaped spikes mounded on the bottom of a sole thereof. In either case, the spikes are generally of metal and secured directly or through thin plates to the sole in the flat form by means of screws or rivets. With this arrangement, soil is liable to get into between the shoe sole and the spikes. When a lateral force is repeatedly exerted on the individual L-shaped spikes, they tend to loosely move relative to the shoe sole. The spikes also penetrate into the ground deeply to the extent that the player has somewhat difficulty in running fast whereas they do not easily dig into an artificial turf. This makes the shoe sole unstable so that the player is in danger of incurring sprains. Upon sliding, the spikes on the forefoot of the shoe sole have the possibility of hitting against another player to injure him.

SUMMARY OF THE INVENTION

It is a main object of the present invention to provide a shoe sole which eliminates the abovementioned disadvantages and has a high safety for baseball or softball players.

According to the present invention, there is provided a baseball or softball shoe comprising a synthetic resin sole including a plurality of projections formed integrally therewith adjacent to the periphery of the sole in its forefoot and heel regions, square rims formed integrally with the sole in each of the forefoot and heel regions to define square recesses at the bottom of the sole and an internally threaded fitting embedded in the sole at the bottom of each of the recesses, an individual L-shaped spike having its complementary base received in each of the recesses, a screw threadedly received in each of the internally threaded fitting through the base of the spike to secure the spike to the sole, and the sole further including a plurality of second projections formed integrally with the sole centrally in its forefoot region.

Other objects and advantages of the present invention will become apparent from the following description when considered with reference to the accompanying drawing in which.

DESCRIPTION OF PREFERRED EMBODIMENT

Figure 1:
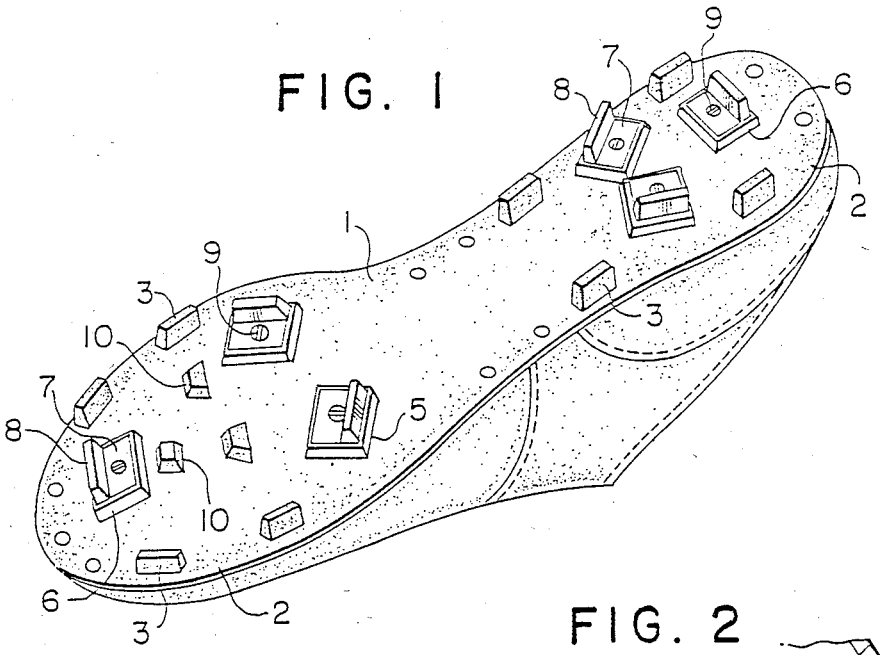
FIG. 1 is a perspective view of one baseball or softball shoes showing their sole.
Figure 2:
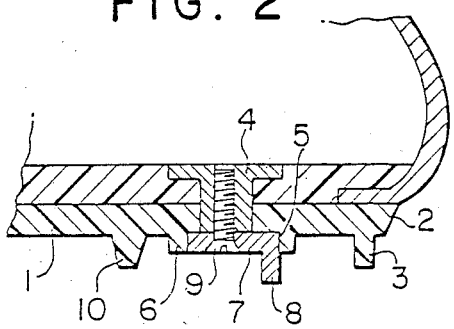
FIG. 2 is a longitudinal sectional view of a forefoot portion of the sole.

Referring to FIG. 1 of the drawing, there is shown one of baseball or softball shoes having a sole 1 constructed in accordance with the present invention. The sole is of synthetic resin and includes a plurality of projections 3 formed integrally therewith adjacent to the periphery 2 of the sole 1. Square rims 6 are positioned substantially at the apexes of a triangle in each of forefoot and heel regions of the sole 1 and formed integrally with the sole to define square recesses 5 at the bottom of the sole. An internally threaded fitting 4 is fixedly embedded in the sole 1 at the bottom of each of the recesses 4. There are provided a plurality of individual L-shaped spikes 8 each having its base 7 complementally received in the square recess 5. The thickness of the bases 7 is such that their lower surface becomes flush with the rims 6 when the bases 7 are fitted in the recesses 5. Each of the spikes 8 is fixedly secured to the bottom of the sole 1 by threading a screw 9 through the base 7 thereof into the internally threaded fitting 4. With this arrangement, when a lateral force is exerted on the spikes 8, the rims 6 prevent the spikes 8 from moving relative to the sole. Because of the close engagement of the bases 7 of the spikes 8 with the rims 6, any soil can not enter the recesses 5. The sole 1 also includes a plurality of second projections 10 formed integrally therewith centrally in the forefoot region of the sole. Preferably, the projections 3 and 10 are slightly shorter in high than the spikes 8.

It will be understood from the foregoing that the projections 3 prevent the spikes 8 from deeply penetrating into the ground to provide stabilization of the sole for preventation of the player's sprains. A combination of the projections 3 and 10 effectively prevents the player from slipping on the ground. When the forefoot of the sole hits against another player during sliding, the projections 3 and 10 serve to minimize the likelihood of injuring another player with the spikes on the forefoot of the sole.

Figure 3:
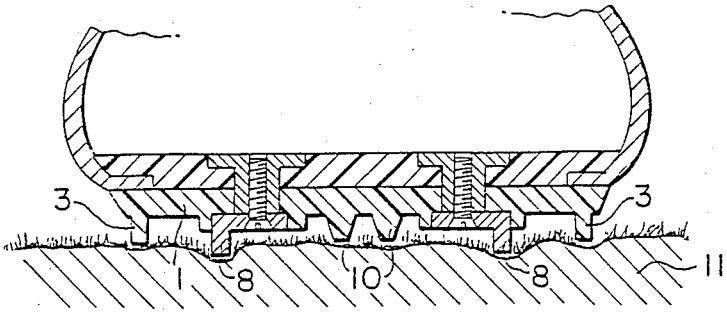
FIG. 3 is a cross-sectional view of the forefoot portion of the sole.

FIG. 3 illustrates how the sole constructed in accordance with the present invention acts on an artificial turf 11.

It will be noted from the foregoing that the safety of the sole is so high that it is suitable for the boy's baseball or softabll shoe.

We claim:

1. A baseball or softball shoe comprising:

a synthetic resin sole including a plurality of projections formed integrally therewith and being located adjacent to a periphery of the synthetic resin sole in its forefoot and heel regions, square rims formed integrally with the sole in each of the forefoot and heel regions defining square recesses at the bottom of the synthetic resin sole, an internally threaded fitting embedded in the synthetic resin sole at the bottom of each of the square recesses, an individual L-shaped spike having a base received in each of the square recesses, said base being shaped complementary to said square recesses, a screw threadedly received in each internally threaded fitting through the base of the spike to secure the spike to the sole, and a plurality of second projections formed integrally with the sole and being located centrally in its forefoot region.

* * * * *